US009674901B2

(12) United States Patent
Yamauchi

(10) Patent No.: US 9,674,901 B2
(45) Date of Patent: Jun. 6, 2017

(54) HIGH-FREQUENCY HEATING DEVICE WITH RANGE HOOD

(71) Applicant: Panasonic Corporation, Kadoma-shi, Osaka (JP)

(72) Inventor: Masato Yamauchi, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 256 days.

(21) Appl. No.: 14/361,570

(22) PCT Filed: Nov. 30, 2012

(86) PCT No.: PCT/JP2012/007719
§ 371 (c)(1),
(2) Date: May 29, 2014

(87) PCT Pub. No.: WO2013/080572
PCT Pub. Date: Jun. 6, 2013

(65) Prior Publication Data

US 2014/0319124 A1 Oct. 30, 2014

(30) Foreign Application Priority Data

Dec. 1, 2011 (JP) ..... 2011-263294
Dec. 1, 2011 (JP) ..... 2011-263295
Dec. 28, 2011 (JP) ..... 2011-288444

(51) Int. Cl.
*H05B 3/06* (2006.01)
*H05B 6/64* (2006.01)
*F24C 15/20* (2006.01)

(52) U.S. Cl.
CPC ..... *H05B 6/6402* (2013.01); *F24C 15/20* (2013.01); *F24C 15/2042* (2013.01); *F24C 15/2064* (2013.01); *H05B 6/6423* (2013.01)

(58) Field of Classification Search
CPC ..... H05B 6/6429; H05B 6/66; H05B 6/6444; H05B 6/6402; H05B 6/6423;
(Continued)

(56) References Cited

U.S. PATENT DOCUMENTS

2003/0015525 A1* 1/2003 Yamauchi ..... H05B 6/6429 219/757

FOREIGN PATENT DOCUMENTS

JP 2003-028431 A 1/2003
JP 2003-139336 A 5/2003
(Continued)

OTHER PUBLICATIONS

International Search Report dated Jan. 11, 2013 from WIPO application No. PCT/JP2012/007719.

*Primary Examiner* — Shawntina Fuqua
(74) *Attorney, Agent, or Firm* — Brinks Gilson & Lione

(57) ABSTRACT

A high-frequency heating device with a range hood is equipped with a heating chamber, a magnetron for supplying high-frequency power, a chamber illumination device disposed adjacent, from outside, to a wall of the heating chamber, and an LED illumination device which is disposed in a bottom portion of the main body and illuminates a heat-cooking device. The LED illumination device uses light-emitting diode elements, and illumination light emitted from the LED illumination device is concentrated by a reflection plate whose surface is plated.

6 Claims, 7 Drawing Sheets

(58) Field of Classification Search
CPC .... Y02B 40/143; F24C 15/20; F24C 15/2042;
F24C 15/2064
See application file for complete search history.

(56) References Cited

FOREIGN PATENT DOCUMENTS

| | | | |
|---|---|---|---|
| JP | 2005-024964 | A | 1/2005 |
| JP | 2011-150936 | A | 8/2011 |
| JP | 2011-187209 | A | 9/2011 |

* cited by examiner

HIGH-FREQUENCY HEATING DEVICE WITH RANGE HOOD

This application is a 371 application of PCT/JP2012/007719 having an international filing date of Nov. 30, 2012, which claims priority to JP2011-263294 filed Dec. 1, 2011, JP2011-263295 filed Dec. 1, 2011 and JP2011-288444 filed Dec. 28, 2011, the entire contents of which are incorporated herein by reference.

TECHNICAL FIELD

The present invention relates to a high-frequency heating device. More specifically, the invention relates to a high-frequency heating device with a range hood which has a hood fan function for discharging, for circulation within the room or discharge from the house, gas that is generated by another heat-cooking device installed under the device main body and is equipped with an illumination device for illuminating what is to be cooked by the other cooking device.

BACKGROUND ART

Conventionally, illumination devices of high-frequency heating devices with a range hood are equipped with a lower illumination lamp which is attached to the bottom surface of the heating device main body and a heating chamber illumination lamp (chamber lamp) which is disposed inside the heating device main body (refer to Patent Document 1, for example).

Lower illumination lamps are required to have a function of illuminating a gas or electric heat-cooking device installed under the high-frequency heating device and what is being cooked by the heat-cooking device. Therefore, lower illumination lamps are required to provide sufficient illuminance to enable judgment of the degree of cooking of what is being cooked by a gas cooker below. Furthermore, customers (users) require lower illumination lamps to also function as kitchen illumination lamps (indirect illumination). Lower illumination lamps are used at a much higher frequency for much longer time than heating chamber illumination lamps which are used as chamber lamps.

Furthermore, attached to the bottom surface of the main body of the high-frequency heating device, lower illumination lamps tend to be affected by a high temperature of gas that is generated by a gas or electric heat-cooking device installed under the high-frequency heating device. Still further, illumination devices including lower illumination lamps are required to exhibit high insulation performance for the voltage of a home commercial power source even in a high-temperature, high-humidity environment.

Patent Document 1: JP-A-2003-28431

SUMMARY OF THE INVENTION

Problem to be Solved by the Invention

However, on the other hand, in recent years, as gas or electric cooking devices which are installed under the main bodies of high-frequency heating devices have been increased in functionality (from four-burner cookers (previous mainstream cookers) to five-burner ones), lower illumination lamps have come to be enhanced in illumination function so as to be able to illuminate a wider area. As measures for satisfying this requirement, lower illumination lamps have been enhanced in performance and diversified as exemplified by switching from incandescent lamps to halogen lamps and a change of power consumption from 20 W to 40 W.

As lower illumination lamps disposed under the main body have been increased in output power as mentioned above, they have been increased in size and generated heat and their insulation structures have become more complex to satisfy high-level requirements.

On the other hand, specifications such as the type (e.g., incandescent or halogen), the attachment structure, and the power in watts vary depending on manufacturers. This raises a problem that when a lower illumination lamp fails, it is difficult for the customer to find, in the market, a proper replacement having the same attachment pin pitch and shape.

Furthermore, where LED elements mounted on a printed circuit board are combined with a reflection plate plated with a conductive material which is attached for the purpose of light concentration, the following problem arises. Long spaces need to be provided between the LED elements and the reflection plate because short-circuiting may otherwise occur between them due to contact, but such long spaces lower the light concentration efficiency.

An object of the present invention is to provide a high-frequency heating device with a range hood in which replacement of an illumination device(s) is almost unnecessary by virtue of its long life.

Means for Solving the Problem

A high-frequency heating device with range hood of the present invention is a high-frequency heating device with range hood which is installed over a heat-cooking device for cooking an object to be heated, including: a heating chamber which is provided in a main body of the high-frequency heating device with range hood and which stores the object to be heated; a high-frequency waves generation unit which supplies high-frequency power to an inside of the heating chamber; a chamber illumination device disposed adjacent, from outside, to a wall of the heating chamber; a lower illumination device which is disposed in a bottom portion of the main body of the high-frequency heating device with range hood and which illuminates the heat-cooking device; and a control unit which controls the high-frequency waves generation unit, the chamber illumination device, and the lower illumination device, wherein the lower illumination device is an LED illumination device using a light-emitting diode element, and is supplied with power of a voltage lower than commercial power from a switching power supply which is controlled by the control unit, and wherein the lower illumination device includes a plated reflection plate for light concentration of increased illumination efficiency.

Since the LED illumination device having the reflection plate is used as the lower illumination device, the luminance of the light source can be efficiently used for illumination and the power consumption can be minimized to suppress unnecessary heat generation, that is, to lower the amount of heat generated by the lower illumination device itself. As a result, the life of the lower illumination device is elongated and the ease of use is increased remarkably.

The bottom portion of the main body of the high-frequency heating device with a range hood is exposed to high temperatures due to heat coming from the heat-cooking device. However, since the LED illumination device which operates on low-voltage power of about 40 V or lower is used as the lower illumination device, the electric insulation structure can be simplified and safety can be increased remarkably.

A high-frequency heating device with range hood of the present invention is a high-frequency heating device with range hood which is installed over a heat-cooking device for cooking an object to be heated, including: a heating chamber which is provided in a main body of the high-frequency heating device with range hood and which stores the object to be heated; a high-frequency waves generation unit which supplies high-frequency power to an inside of the heating chamber; a chamber illumination device disposed adjacent, from outside, to a side wall of the heating chamber; a lower illumination device which is disposed in a bottom portion of the main body of the high-frequency heating device with range hood and which illuminates the heat-cooking device; and a control unit which controls the high-frequency waves generation unit, the chamber illumination device, and the lower illumination device, wherein the lower illumination device is an LED illumination device using a light-emitting diode, and is supplied with power from a switching power supply which is controlled by the control unit.

Since the LED illumination device is used as the lower illumination device, the life of the lower illumination device is elongated and it comes to be semipermanently usable, which means that no replacement work is necessary for the lower illumination device and hence the ease of use is increased.

Furthermore, since the LED illumination device is used as the lower illumination device, the power consumption of the high-frequency heating device with a range hood can be lowered and the saved part of the power consumption can be allocated to the high-frequency heat-cooking function or the circulation fan function to increase the cooking performance.

Still further, since the voltage supplied to the lower illumination device can be lowered, the electric insulation structure can be simplified and safety can be increased by a simple structure.

A high-frequency heating device with range hood of the present invention is a high-frequency heating device with range hood which is installed over a heat-cooking device for cooking an object to be heated, including: a heating chamber which is provided in a main body of the high-frequency heating device with range hood and which stores the object to be heated; a high-frequency waves generation unit which supplies high-frequency power to an inside of the heating chamber; a chamber illumination device disposed adjacent, from outside, to a wall of the heating chamber; a lower illumination device which is disposed in a bottom portion of the main body of the high-frequency heating device with range hood and which illuminates an object to be cooked in the heat-cooking device or a kitchen; and a control unit which controls the high-frequency waves generation unit, the chamber illumination device, and the lower illumination device, wherein the lower illumination device is an LED illumination device using a light-emitting diode, and is supplied with power from a switching power supply which is controlled by the control unit, and wherein the lower illumination device includes a plated reflection plate for light concentration of increased illumination efficiency.

A method that makes the gap between the reflection plate and the LED element mounted on a printed circuit board as small as possible is employed for efficient concentration of illumination light in combining the reflection plate and the LED element together. That is, portions, to be attached to the circuit board, of the reflection plate which is usually a resin mold is given legs and positioning pins. With this measure, holes of the printed circuit board and positioning holes of the LED element can be formed in the same part in the same manufacturing step, whereby a high-accuracy positioning structure can be realized. As a result, the luminance of the light source can be efficiently used for illumination. The illumination device comes to be semipermanently usable, which means that no replacement work is necessary for it. The ease of use is thus increased remarkably.

Advantages of the Invention

In the high-frequency heating device with a range hood according to the invention, the LED illumination device which operates on low-voltage power of about 40 V or lower is used as the lower illumination device and the cooling effect is enhanced using a structure including a heat radiation plate and an attachment plate. As a result, the life of the lower illumination device is elongated and it comes to be semipermanently usable, which means that no replacement is necessary for it. Furthermore, the ease of use is increased, and safety can be increased while the electric insulation structure is simplified.

In the high-frequency heating device with a range hood according to the invention, since the LED illumination device is used as the lower illumination device, the life of the lower illumination device is elongated and it comes to be semipermanently usable, which means that no replacement work is necessary for it. The ease of use is thus increased. Since the power consumption of the high-frequency heating device can be lowered, the saved part of the power consumption can be allocated to the high-frequency heat-cooking function or the circulation fan function to increase the cooking performance. Furthermore, since the voltage supplied to the lower illumination device can be lowered, safety can be increased while the insulation structure is simplified.

The high-frequency heating device with a range hood according to the invention makes it possible to optimize fitting dimensions that are used in combining the LED element and the reflection plate together, provide maximum illuminance, and increase safety and reliability by preventing short-circuiting in conductive portions. Furthermore, since the LED illumination device which operates on low-voltage power of about 40 V or lower is used as the lower illumination device, the life of the lower illumination device is elongated and it comes to be semipermanently usable, which means that no replacement is necessary for it. Furthermore, the ease of use is increased, and safety can be increased while the electric insulation structure is simplified.

DETAILED DESCRIPTION OF THE PREFERRED EMBODIMENTS

Figure 1:
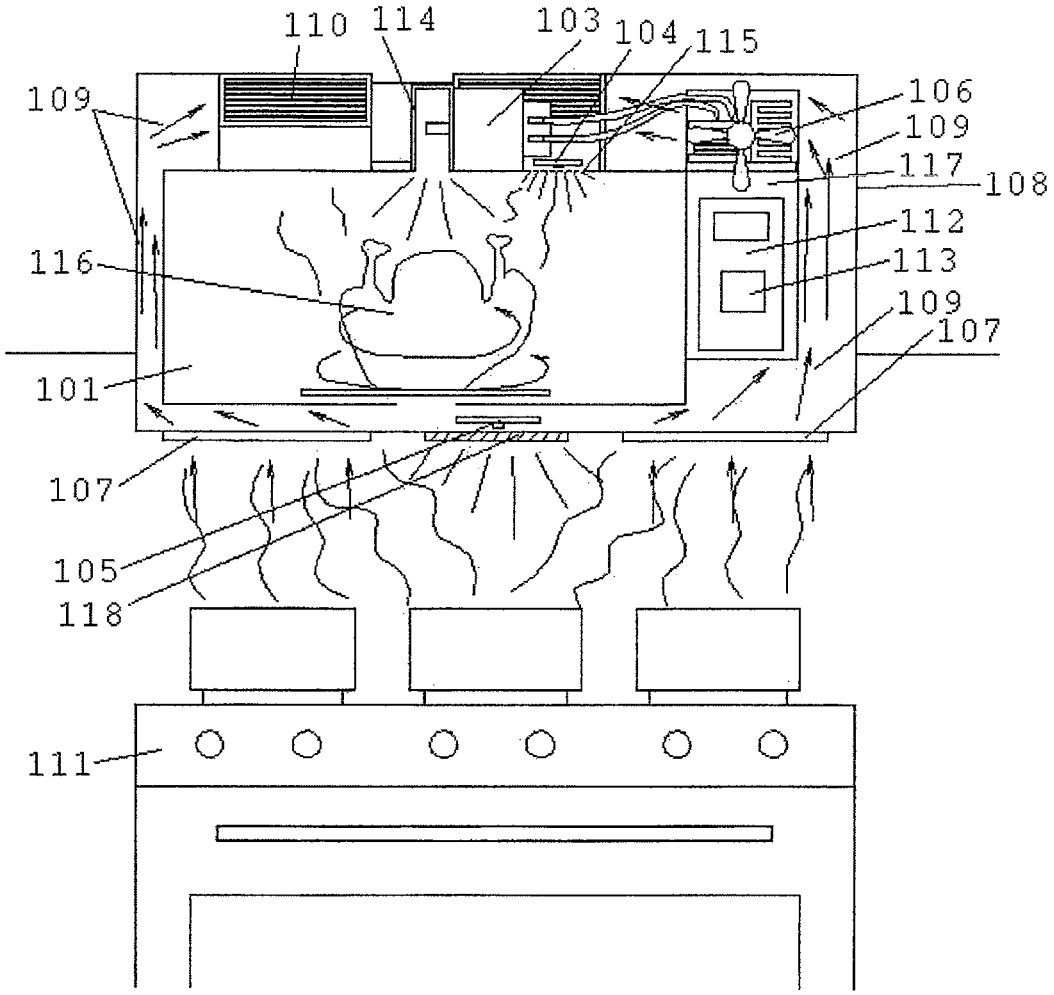
FIG. 1 shows the structure of a high-frequency heating device with a range hood according to a first embodiment of the present invention.

A first aspect of the present invention provides a high-frequency heating device with range hood which is installed over a heat-cooking device for cooking an object to be heated, including: a heating chamber which is provided in a main body of the high-frequency heating device with range hood and which stores the object to be heated; a high-frequency waves generation unit which supplies high-frequency power to an inside of the heating chamber; a chamber illumination device disposed adjacent, from outside, to a wall of the heating chamber; a lower illumination device which is disposed in a bottom portion of the main body of the high-frequency heating device with range hood and which illuminates the heat-cooking device; and a control unit which controls the high-frequency waves generation unit, the chamber illumination device, and the lower illumination device, wherein the lower illumination device is an LED illumination device using a light-emitting diode element, and is supplied with power of a voltage lower than commercial power from a switching power supply which is controlled by the control unit, and wherein the lower illumination device includes a plated reflection plate for light concentration of increased illumination efficiency.

With this configuration, low-voltage power of about 40 V or lower is supplied to the LED illumination device (lower illumination device) from the switching power supply controlled by the control unit. Although the chamber illumination device is the LED illumination device having a small light emission source that uses a light-emitting diode, the reflection plate whose surface is plated makes it possible to efficiently illuminate the object to be cooked that is distributed over a wide area of a lower cooker having five burners which has come into wide use in recent years. As a result, the power consumption can be minimized to suppress unnecessary heat generation, that is, to lower the amount of heat generated by the LED illumination device itself. Thus, the life of the LED illumination device is elongated and the electric insulation structure is simplified. Safety and the ease of use can thus be increased.

In a second aspect of the invention which is made particularly in the first aspect of the invention, the light-emitting diode element is mounted on an aluminum heat conduction plate having high heat conductivity to increase a heat dissipation effect, and the aluminum heat conduction plate is mechanically fixed to the plated reflection plate and an attachment plate which releases heat from the aluminum heat conduction plate to a bottom wall of the heating chamber.

With this measure, the effect of dissipating heat from the light-emitting diode element is enhanced, whereby the life of the lower illumination device is elongated and it comes to be semipermanently usable, which means no replacement work is necessary for it. The ease of use can thus be increased remarkably.

A third aspect of the present invention provides a high-frequency heating device with range hood which is installed over a heat-cooking device for cooking an object to be heated, including: a heating chamber which is provided in a main body of the high-frequency heating device with range hood and which stores the object to be heated; a high-frequency waves generation unit which supplies high-frequency power to an inside of the heating chamber; a chamber illumination device disposed adjacent, from outside, to a side wall of the heating chamber; a lower illumination device which is disposed in a bottom portion of the main body of the high-frequency heating device with range hood and which illuminates the heat-cooking device; and a control unit which controls the high-frequency waves generation unit, the chamber illumination device, and the lower illumination device, wherein the lower illumination device is an LED illumination device using a light-emitting diode, and is supplied with power from a switching power supply which is controlled by the control unit.

Since the LED illumination device is used as the lower illumination device, the life of the lower illumination device is elongated and it comes to be semipermanently usable, which means that no replacement work is necessary for it. The ease of use is thus increased. Since the power consumption of the high-frequency heating device can be lowered, the saved part of the power consumption can be allocated to the high-frequency heat-cooking function or the circulation fan function to increase the cooking performance. Furthermore, since the voltage supplied to the lower illumination device can be lowered, safety can be increased while the insulation structure is simplified.

In a fourth aspect of the invention which is made particularly in the third aspect of the invention, the chamber illumination device is an LED illumination device using a light-emitting diode, and is supplied with power from the switching power supply which is controlled by the control unit.

From the viewpoint of the entire high-frequency heating device, no lamp (illumination device) replacement work is necessary and hence the ease of use is increased. Also, the power consumption of the high-frequency heating device can be lowered.

A fifth aspect of the present invention provides a high-frequency heating device with range hood which is installed over a heat-cooking device for cooking an object to be heated, including: a heating chamber which is provided in a main body of the high-frequency heating device with range hood and which stores the object to be heated; a high-frequency waves generation unit which supplies high-frequency power to an inside of the heating chamber; a chamber illumination device disposed adjacent, from outside, to a wall of the heating chamber; a lower illumination device which is disposed in a bottom portion of the main body of the high-frequency heating device with range hood and which illuminates an object to be cooked in the heat-cooking device or a kitchen; and a control unit which controls the high-frequency waves generation unit, the chamber illumination device, and the lower illumination device, wherein the lower illumination device is an LED illumination device using a light-emitting diode, and is supplied with power from a switching power supply which is controlled by the control unit, and wherein the lower illumination device includes a plated reflection plate for light concentration of increased illumination efficiency.

Low-voltage power of about 40 V or lower is supplied to the LED illumination device (lower illumination device). Although the chamber illumination device is the LED illumination device having a small light emission source that uses a light-emitting diode, the reflection plate whose surface is plated makes it possible to efficiently illuminate the object to be cooked that is distributed over a wide area of a lower cooker having five burners which has come into wide use in recent years.

The LED element as the light emission source is mounted on a printed circuit board and light emitted from the LED element is concentrated by the reflection plate whose surface is plated, whereby the illumination efficiency is increased.

Electricity flows through the plating layer formed on the surface of the reflection plate. Therefore, if the LED element or one of its solder portions comes into contact with the reflection plate, short-circuiting or a disconnection may occur to cause a failure or damage.

In the invention, the positioning accuracy of individual members constituent parts is increased so that the insulation distances between the LED element and the reflection can be minimized. As a result, an electric failure is prevented from occurring between the LED element and the reflection and the illumination device is thereby prevented from being damaged by such an event. Thus, the illumination efficiency can be increased to a large extent.

In a sixth aspect of the invention which is made particularly in the fifth aspect of the invention, the reflection plate is mounted on a printed circuit board, is formed by a resin mold including a plated surface to enhance the illumination efficiency, concentrates light emitted from the LED element mounted on the printed circuit board to increase illuminance, and includes positioning pins. The printed circuit board has positioning holes to provide an insulation space length between the reflection plate and the LED element and its neighborhood.

In this reflection plate structure, portions for joining to the printed circuit board are given leg-shapes, whereby flow passages of a cooling wind are secured to enhance the effect of cooling the LED element which heats up to a high temperature. This makes it possible to increase the input current to the LED element whose use temperature has an upper limit for a guarantee of quality. As a result, not only can the luminance of the illumination device be increased but also the life of the LED element can be elongated. Since the high-luminance LED element comes to be semipermanently usable, no replacement work is necessary for it and hence the ease of use can be increased remarkably.

Embodiments of the invention will be hereinafter described with reference to the drawings. However, the invention is not limited by these embodiments.

Embodiment 1

Figure 2:
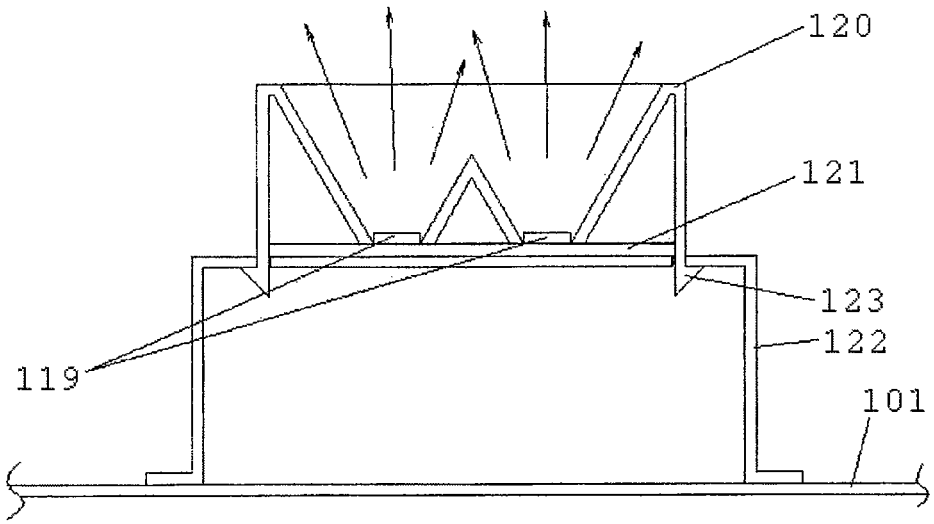
FIG. 2 shows an attachment structure of an LED illumination device of the high-frequency heating device with a range hood according to the first embodiment of the invention.
Figure 3A:
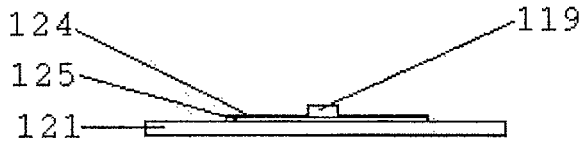
FIGS. 3(*a*) and 3(*b*) are schematic diagrams illustrating differences in electric insulation structure between the LED illumination device of the high-frequency heating device with a range hood according to the first embodiment of the invention and a conventional illumination device.
Figure 3B:
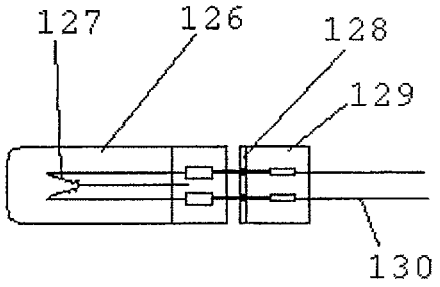
Figure 4:
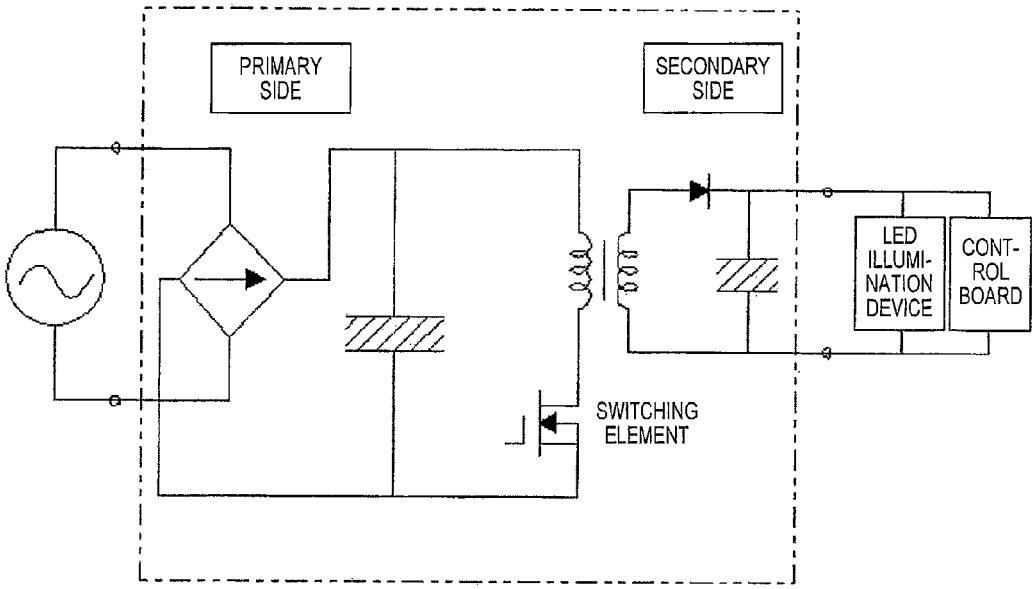
FIG. 4 is a schematic diagram of a control circuit of a switching power supply which is a power source of the LED illumination device of the high-frequency heating device with a range hood according to the first embodiment of the invention.

FIG. 1 shows the structure of a microwave oven 108 with a range hood according to a first embodiment of the invention. FIG. 2 shows an attachment structure of an LED illumination device 105 of the microwave oven 108 with a range hood according to the first embodiment of the invention. FIGS. 3(*a*) and 3(*b*) are schematic diagrams illustrating differences in electric insulation structure between the LED illumination device 105 of the microwave oven 108 with a range hood according to the first embodiment of the invention and a conventional illumination device. FIG. 4 is a schematic diagram of a control circuit of a switching power supply 113 which is a power source of the LED illumination device 105 of the microwave oven 108 with a range hood according to the first embodiment of the invention.

As shown in FIG. 1, the microwave oven 108 with a range hood (high-frequency heating device with a range hood) is installed over a gas cooker 111 (heat-cooking device). A circulation fan 110 is disposed at a top position in the microwave oven 108 with a range hood. The circulation fan 110 discharges gas that is generated by the gas cooker 111 and taken in through generated gas suction inlets 107 formed through a bottom wall of the microwave oven 108 with a range hood, from the house through backside discharge passages 109 of the microwave oven 108 with a range hood.

A heating chamber 101 which stores an object 116 to be high-frequency cooked (an object to be heated) such as food to perform heat cooking on the object 116 is formed in the main body of the microwave oven 108 with a range hood. A device chamber 117 is formed beside the heating chamber 101 in the main body of the microwave oven 108 with a range hood, and a magnetron 103 (high-frequency waves generation unit) is disposed in the device chamber 117. High-frequency radio waves in the 2.45 GHz band generated by the magnetron 103 propagate through a waveguide 114 and are supplied to the inside of the heating chamber 101.

The LED illumination device 105 (lower illumination device) for illuminating the gas cooker 111 is disposed in a bottom portion of the microwave oven 108 with a range hood. The LED illumination device 105 illuminates the gas cooker 111 using light-emitting diode elements (LEDs).

A lower illumination light transmission window 118 is attached to the bottom wall of the microwave oven 108 with a range hood so as to be disposed under the LED illumination device 105. The lower illumination light transmission window 118 prevents high-temperature, high-humidity gas generated by the gas cooker 111 from coming in close to the neighborhood of the LED illumination device 105.

DC power of 12V is supplied to the LED illumination device 105 from the switching power supply 113.

Although in this embodiment the 12-V voltage is supplied to the LED illumination device 105, the invention is not limited to such a case. For example, the power source for the LED illumination device 105 may be a low-voltage power source which provides a voltage that is lower than about 40 V.

A control unit 112 is disposed in the device chamber 117. The control unit 112 on/off-controls the magnetron 103, the LED illumination device 105, and the switching power supply 113.

How the microwave oven 108 with a range hood according to the first embodiment operates and works will be described below.

First, to perform cooking using the microwave oven 108 with a range hood, high-frequency radio waves are supplied to the heating chamber 101 of the microwave oven 108 with a range hood by causing the magnetron 103 to operate in a state that the object 116 to be high-frequency cooked is stored in the heating chamber 101. The object 116 to be high-frequency cooked stored in the heating chamber 101 is thereby heated.

In the embodiment, to perform cooking using the heat-cooking device such as the gas cooker 111, the user on-manipulates the LED illumination device 105 (lower illumination device) irrespective of whether the cooking is being performed using the microwave oven 108 with a range hood. In response, the control unit 112 converts the commercial voltage into a low voltage (12 V) by turning on the switching power supply 113 and supplies resulting power to the LED illumination device 105. Since the LED illumination device 105 illuminates the object to be cooked by the gas cooker 111, illuminance that is suitable for cooking by the user using the gas cooker 111 is obtained. When the cooking has been completed, the control unit 112 turns off the switching power supply 113 and hence the LED illumination device 105 goes off.

The LED illumination device 105 is also used as an indirect illumination device or a kitchen illumination lamp. That is, the LED illumination device 105 may be turned on irrespective of whether the microwave oven 108 with a range hood or the gas cooker 111 is in operation or is to operate.

FIG. 4 is a schematic diagram of the control circuit of the switching power supply 113 of the microwave oven 108 with a range hood.

The LED illumination device 105 (lower illumination device) is required to be brighter than a chamber illumination device 104. The brightness of the chamber illumination device 104 may be such as to allow the user to recognize the degree of cooking of the object 116 (to be high-frequency cooked) being cooked in the heating chamber 101. In contrast, the LED illumination device 105 (lower illumination device) is required to be brighter than the chamber illumination device 104 because the former is used for illuminating the gas cooker 111 which is a wide heat-cooling device having five burners or illuminating the kitchen as an interior illumination device.

Since as described above the LED illumination device 105 is required to be sufficiently bright as an illumination device, it generates a large amount of heat by itself. In addition, the LED illumination device 105 frequently operates in a high-temperature atmosphere of high-temperature, high-humidity gas generated by the gas cooker 111. The LED illumination device 105 has a characteristic that its life is shortened if it continues to operate in a high-temperature condition. In view of this, in the embodiment, to cause light emitted from the LED illumination device 105 to efficiently shine on the object to be cooked that is placed below, the LED illumination device 105 is provided with a reflection plate 120 whose surface is plated to reduce its power consumption to a minimum necessary value.

Furthermore, to suppress temperature increase due to self heating of the LED illumination device 105, the light-emitting diode elements 119 are placed on an aluminum heat conduction plate 121 which is high in heat conduction. The aluminum heat conduction plate 121 is fixed, with screws or mechanical fixing members 123, to an attachment plate 122 for dissipating heat to the bottom wall of the heating chamber 101 which is low in temperature and the plated reflection plate 120.

FIG. 2 shows the attachment structure of the LED illumination device 105 of the microwave oven 108 with a range hood.

As described above, in the embodiment, the structure can be realized which not only minimizes the power consumption of the LED illumination device 105 but also provides a maximum heat dissipation effect. As a result, the life of the lower illumination device is elongated and it comes to be semipermanently usable, which means that no replacement work is necessary for the lower illumination device. The ease of use is thus increased remarkably.

Since the lower illumination device is the LED illumination device 105 which can operate on low-voltage power, necessary electric insulation performance can be attained by a simplified structure and hence safety can be increased by a simple structure. FIGS. 3(*a*) and 3(*b*) illustrate differences in electric insulation structure between the LED illumination device 105 of the microwave oven 108 with a range hood and a conventional illumination device. FIG. 3(*a*) shows the structure of the LED illumination device 105 of the microwave oven 108 with a range hood according to the first embodiment. FIG. 3(*b*) shows the electric insulation structure of the conventional illumination device.

Embodiment 2

Figure 5:
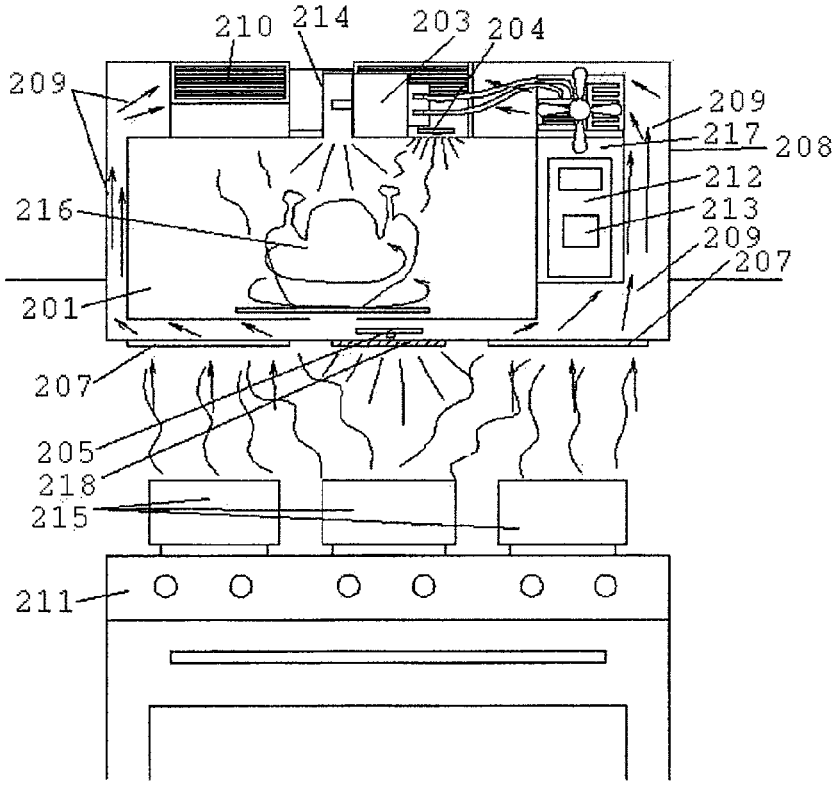
FIG. 5 shows the structure of a high-frequency heating device with a range hood according to a second embodiment of the invention.
Figure 6:
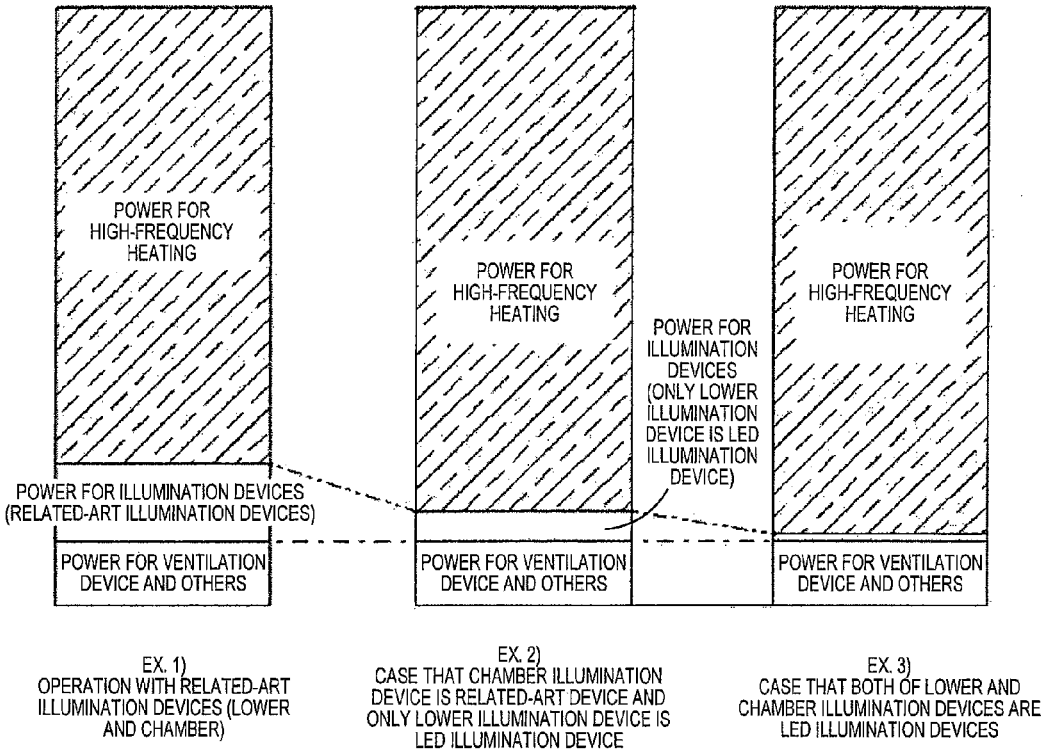
FIG. 6 illustrates a power suppressing effect of an LED illumination device of the high-frequency heating device with a range hood according to the second embodiment of the invention.
Figure 7:
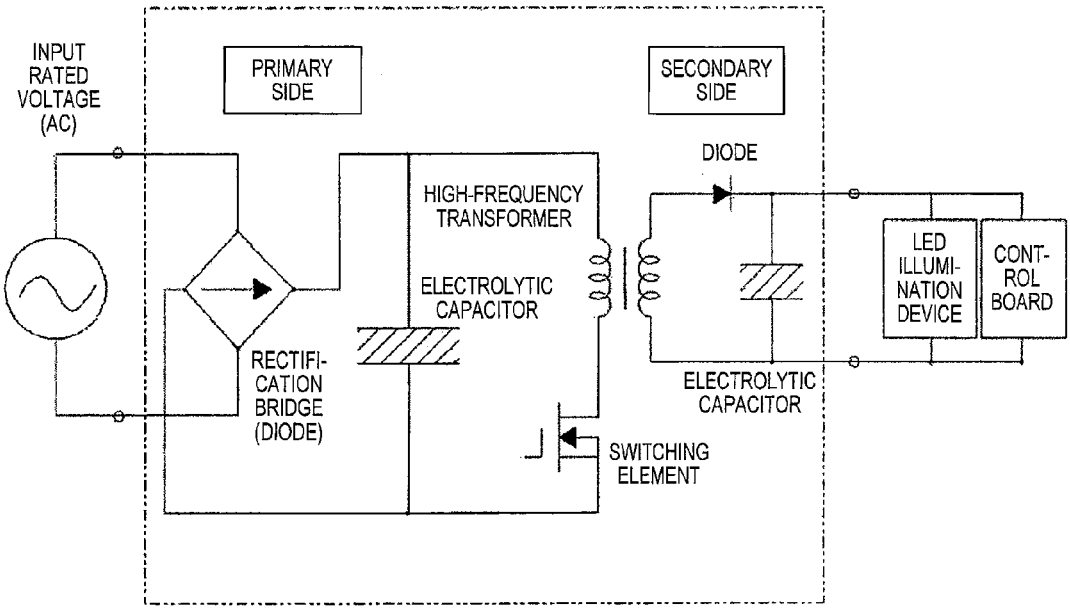
FIG. 7 is a schematic diagram of a control circuit of a switching power supply of the high-frequency heating device with a range hood according to the second embodiment of the invention.

FIG. 5 shows the structure of a microwave oven 208 with a range hood according to a second embodiment of the invention. FIG. 6 illustrates a power suppressing effect of an LED illumination device of the microwave oven 208 with a range hood according to the second embodiment of the invention. FIG. 7 is a schematic diagram of a control circuit of a switching power supply 213 of the microwave oven 208 with a range hood according to the second embodiment of the invention.

As shown in FIG. 5, the microwave oven 208 with a range hood (high-frequency heating device with a range hood) is installed over a gas cooker 211 (heat-cooking device). A circulation fan 210 is disposed at a top position in the microwave oven 208 with a range hood. The circulation fan 210 discharges gas that is generated by the gas cooker 211 and taken in through generated gas suction inlets 207 formed through a bottom wall of the microwave oven 208 with a range hood, from the house through backside discharge passages 209 of the microwave oven 208 with a range hood.

A heating chamber 201 which stores an object 216 to be high-frequency cooked (an object to be heated) such as food and to perform heat cooking on the object 216 is formed in the main body of the microwave oven 208 with a range hood. A device chamber 217 is formed beside the heating chamber 201 in the main body of the microwave oven 208 with a range hood, and a magnetron 203 (high-frequency waves generation unit) is disposed in the device chamber 217. High-frequency radio waves in the 2.45 GHz band generated by the magnetron 203 propagate through a waveguide 214 and are supplied to the inside of the heating chamber 201.

The heating chamber 201 is approximately shaped like a rectangular parallelepiped and its front opening is provided with a door (not shown) which can open and close. Plural holes are formed through a wall of the heating chamber 201 so as to prevent leakage of high-frequency radio waves. An LED illumination device 204 (chamber illumination device) is disposed outside the wall so as to be adjacent to the holes. The LED illumination device 204 illuminates the inside of the LED illumination device 204 through the holes so that the user can check the degree of cooking.

An LED illumination device 205 (lower illumination device) for illuminating the gas cooker 211 is disposed in a bottom portion of the microwave oven 208 with a range hood. The LED illumination device 205 illuminates the gas cooker 211 using light-emitting diode elements (LEDs).

A lower illumination light transmission window 218 is attached to the bottom wall of the microwave oven 208 with a range hood so as to be disposed under the LED illumination device 205. The lower illumination light transmission window 218 prevents high-temperature, high-humidity gas generated by the gas cooker 211 from coming in close to the neighborhood of the LED illumination device 205.

DC power of 12V is supplied to the LED illumination devices 204 and 205 from the switching power supply 213.

Although in this embodiment the 12-V voltage is supplied to the LED illumination devices 204 and 205, the invention is not limited to such a case. For example, the power source for the LED illumination devices 204 and 205 may be a low-voltage power source which provides a voltage that is lower than about 40 V.

A control unit 212 is disposed in the device chamber 217. The control unit 212 on/off-controls the magnetron 203, the LED illumination devices 204 and 205, and the switching power supply 213.

How the microwave oven 208 with a range hood according to the second embodiment operates and works will be described below.

First, to perform cooking using the microwave oven 208 with a range hood, high-frequency radio waves are supplied to the heating chamber 201 of the microwave oven 208 with a range hood by causing the magnetron 203 to operate in a state that the object 216 to be high-frequency cooked is stored in the heating chamber 201. The object 216 to be high-frequency cooked stored in the heating chamber 201 is thereby heated.

In the embodiment, during cooking with the use of the microwave oven 208 with a range hood, the LED illumination device 204 (chamber illumination device) is kept on. And the control unit 212 keeps the switching power supply 213 on to convert the commercial voltage to a low voltage (12 V) and supplies resulting power to the LED illumination device 205. Since the LED illumination device 204 illuminates the inside of the heating chamber 201, the user can check the degree of cooking. Upon completion of the cooking, the control unit 212 turns off the switching power supply 213 and hence the LED illumination device 204 goes off.

FIG. 7 is a schematic diagram of a control circuit of the switching power supply 213 of the microwave oven 208 with a range hood.

To perform cooking using the gas cooker 211 which is installed under the microwave oven 208 with a range hood, the user on-manipulates the LED illumination device 205 to illuminate lower object 215 to be cooked. Or the user on-manipulates the LED illumination device 205 for the purpose of using it as a kitchen illumination lamp (indirect illumination). As soon as the user on-manipulates the LED illumination device 205, the control unit 212 performs a control for turning on the switching power supply 213 and supplying low-voltage power (e.g., DC power of 12 V) to the LED illumination device 205.

When supplied with 12-V power, the LED illumination device 205 illuminates the area under the microwave oven 208 with a range hood. When the user off-manipulates the LED illumination device 205, the control unit 212 turns off the switching power supply 213.

The brightness of the LED illumination device 204 (chamber illumination device) may be lower than that of the LED illumination device 205 (lower illumination device), that is, may be such as to allow the user to recognize the degree of cooking of the object 216 (to be high-frequency cooked) being cooked in the heating chamber 201. In contrast, the LED illumination device 205 (lower illumination device) is required to be brighter than the chamber illumination device 204 because the former is used for illuminating the gas cooker 211 or the kitchen. For example, where the LED illumination device 205 (lower illumination device) is of about 4 W, the LED illumination device 204 (chamber illumination device) may be of about 2 W.

As described above, in the embodiment, since the LED illumination device 205 is used as the lower illumination device, the life of the lower illumination device is elongated and it comes to be semipermanently usable, which means that no replacement work is necessary for the lower illumination device. The ease of use is thus increased.

Since is the LED illumination device 205 is used as the lower illumination device, the power consumption of the high-frequency heating device can be lowered. Therefore, the saved part of the power consumption can be allocated to the high-frequency heat-cooking function or the circulation fan function to increase the cooking performance. FIG. 6 illustrates a power suppressing effect of the LED illumination device of the high-frequency heating device with a range hood.

Furthermore, since the lower illumination device is the LED illumination device 205 which can operate on low-voltage power, the electric insulation structure can be simplified and hence safety can be increased by a simple structure.

Still further, since not only the lower illumination device but also the chamber illumination device is an LED illumination device (204), the same advantages as obtained by employing the LED illumination device 205 as the lower illumination device can be obtained to a larger extent than the advantages obtained by employing the LED illumination device 205 as the lower illumination device.

Embodiment 3

Figure 8:
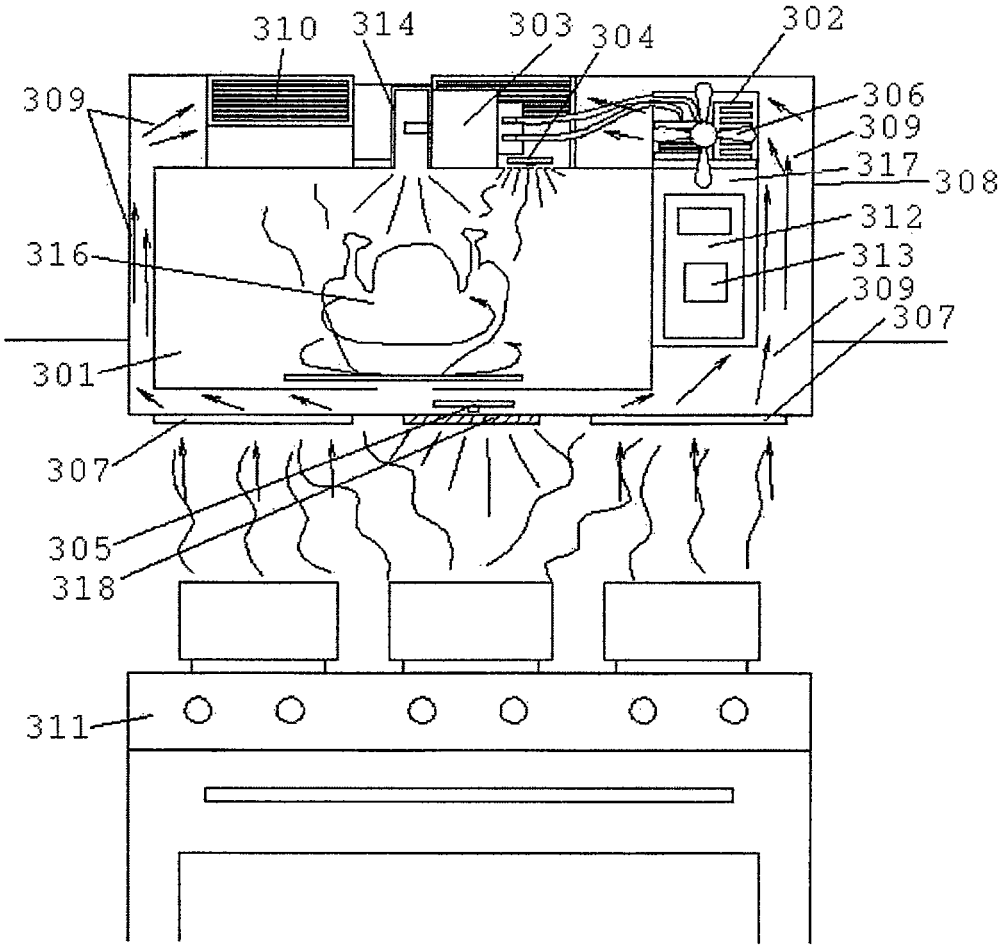
FIG. 8 shows the structure of a high-frequency heating device with a range hood according to a third embodiment of the invention.
Figure 9:
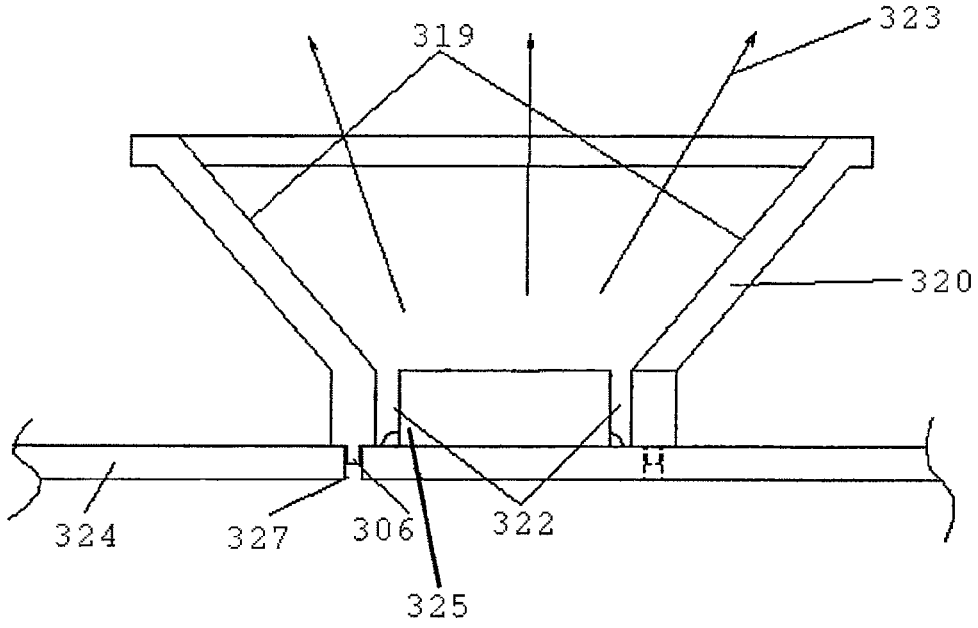
FIG. 9 shows an optimum attachment structure of an LED illumination device of the high-frequency heating device with a range hood according to the third embodiment of the invention.
Figure 10A:
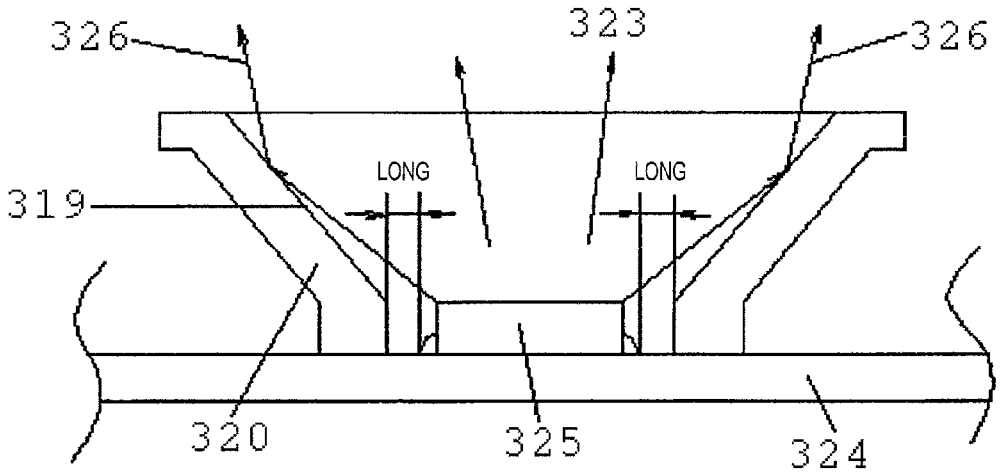
FIG. 10(*a*) is a schematic diagram showing an LED elements-reflection plate attachment structure of a high-frequency heating device with a range hood having an LED illumination device in which an insulation space length is large, FIG. 10(*b*) is a schematic diagram showing an LED elements-reflection plate attachment structure of a high-frequency heating device with a range hood having an LED illumination device in which an insulation space length is not uniform, and FIG. 10(*c*) is a schematic diagram showing an LED elements-reflection plate attachment structure of the high-frequency heating device with a range hood according to the third embodiment of the invention in which optimum insulation space length is provided.
Figure 10B:
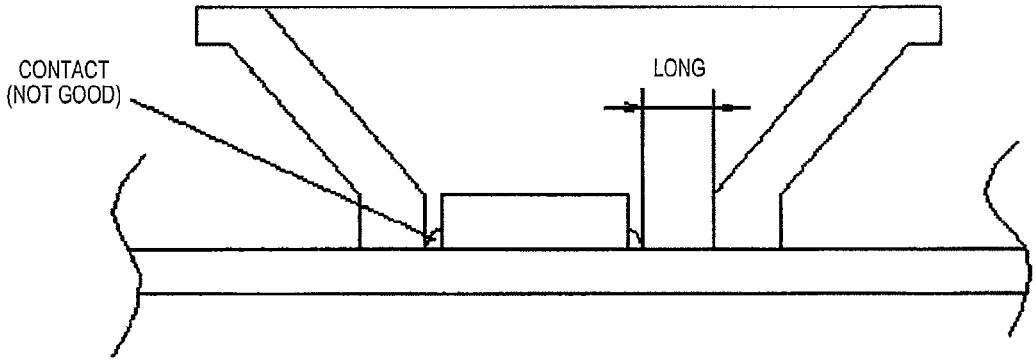
Figure 10C:
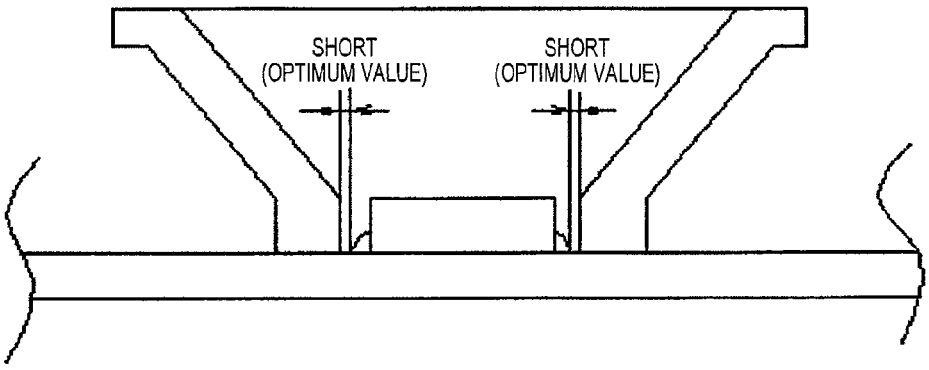

FIG. 8 shows the structure of a microwave oven 308 with a range hood according to a third embodiment of the invention. FIG. 9 shows an attachment structure of an LED illumination device 305 of the microwave oven 308 with a range hood according to the third embodiment of the invention. FIG. 10(*a*) is a schematic diagram showing an LED elements-reflection plate attachment structure of a high-frequency heating device with a range hood having an LED illumination device in which an insulation space length is large. FIG. 10(*b*) is a schematic diagram showing an LED elements-reflection plate attachment structure of a high-frequency heating device with a range hood having an LED illumination device in which an insulation space length is not uniform. FIG. 10(*c*) is a schematic diagram showing an LED elements-reflection plate attachment structure of the microwave oven 308 with a range hood according to the third embodiment of the invention in which an optimum insulation space length is provided.

As shown in FIG. 8, the microwave oven 308 with a range hood (high-frequency heating device with a range hood) is installed over a gas cooker 311 (heat-cooking device). A circulation fan 310 is disposed at a top position in the microwave oven 308 with a range hood. The circulation fan 310 discharges gas that is generated by the gas cooker 311 and taken in through generated gas suction inlets 307 formed through a bottom wall of the microwave oven 308 with a range hood, from the house through backside discharge passages 309 of the microwave oven 308 with a range hood.

A heating chamber 301 which stores an object 316 to be high-frequency cooked (an object to be heated) such as food to perform heat cooking on the object 316 is formed in the main body of the microwave oven 308 with a range hood. The microwave oven 308 with a range hood is equipped with a chamber illumination device 304 for illuminating the object 316 to be high-frequency cooked that is stored in the heating chamber 301.

A device chamber 317 is formed beside the heating chamber 301 in the main body of the microwave oven 308 with a range hood, and a power supply device 302 and a magnetron 303 (high-frequency waves generation unit) are disposed in the device chamber 317. High-frequency radio waves in the 2.45 GHz band generated by the magnetron 303 propagate through a waveguide 314 and are supplied to the inside of the heating chamber 301.

An LED illumination device 305 (lower illumination device) for illuminating the gas cooker 311 is disposed in a bottom portion of the microwave oven 308 with a range hood. The LED illumination device 305 illuminates the gas cooker 311 using light-emitting diode elements (LEDs).

A lower illumination light transmission window 318 is attached to the bottom wall of the microwave oven 308 with a range hood so as to be disposed under the LED illumination device 305. The lower illumination light transmission window 318 prevents high-temperature, high-humidity gas generated by the gas cooker 311 from coming in close to the neighborhood of the LED illumination device 305.

DC power of 12V is supplied to the LED illumination device 305 from a switching power supply 313.

Although in this embodiment the 12-V voltage is supplied to the LED illumination device 305, the invention is not limited to such a case. For example, the power source for the LED illumination device 305 may be a low-voltage power source which provides a voltage that is lower than about 40 V.

A control unit 312 is disposed in the device chamber 317. The control unit 312 on/off-controls the magnetron 303, the LED illumination device 305, and the switching power supply 313.

How the microwave oven 308 with a range hood according to the third embodiment operates and works will be described below.

First, to perform cooking using the microwave oven 308 with a range hood, high-frequency radio waves are supplied to the heating chamber 301 of the microwave oven 308 with a range hood by causing the magnetron 303 to operate in a state that the object 316 to be high-frequency cooked is stored in the heating chamber 301. The object 316 to be high-frequency cooked stored in the heating chamber 301 is thereby heated.

In the embodiment, to perform cooking using the lower heat-cooking device such as the gas cooker 311, the user on-manipulates the LED illumination device 305 (lower illumination device) irrespective of whether the cooking is being performed using the microwave oven 308 with a range hood. In response, the control unit 312 converts the commercial voltage into a low voltage (12 V) by turning on the switching power supply 313 and supplies resulting power to the LED illumination device 305. Since the LED illumination device 305 illuminates the object to be cooked by the gas cooker 311, illuminance that is suitable for cooking by the user using the gas cooker 311 is obtained. When the cooking has been completed, the control unit 312 turns off the switching power supply 313 and hence the LED illumination device 305 goes off.

The LED illumination device 305 is also used as an indirect illumination device or a kitchen illumination lamp. That is, the LED illumination device 305 may be turned on irrespective of whether the microwave oven 308 with a range hood or the gas cooker 311 is in operation is to operate.

The LED illumination device 305 (lower illumination device) is required to be brighter than the chamber illumination device 304. The brightness of the chamber illumination device 304 may be such as to allow the user to recognize the degree of cooking of the object 316 (to be high-frequency cooked) being cooked in the heating chamber 301. In contrast, the LED illumination device 305 which is the device for illuminating the gas cooker 311 installed under the microwave oven 308 with a range hood is required to be brighter than the chamber illumination device 304 because the former is used for illuminating a wide area of the gas cooker 311 which has a maximum of five burners or illuminating the kitchen as an interior illumination device.

Since as described above the LED illumination device 305 is required to be sufficiently bright as an illumination device, it generates a large amount of heat by itself. In addition, the LED illumination device 305 frequently operates in a high-temperature atmosphere of high-temperature, high-humidity gas generated by the gas cooker 311. The LED illumination device 305 has a characteristic that its life is shortened if it continues to operate in a high-temperature condition. In view of this, in the embodiment, to cause light emitted from the LED illumination device 305 to efficiently shine on the object to be cooked that is placed below, the LED illumination device 305 is provided with a reflection plate 320 whose surface is plated to reduce its power consumption to a minimum necessary value.

Referring to FIG. 9, a description will be made of advantages that are provided by a spatial structure including positioning pins 306 of the refection plate 320 and a portion adjacent to a printed circuit board 324.

To increase the efficiency of concentration of illumination light 323 emitted from LED elements 325, the reflection plate 320 needs to be as close to the LED elements 325 as possible. Since the illumination light 323 emitted from LED elements 325 mounted on the printed circuit board 324 go straight in itself, the light concentration efficiency of the reflection plate 320 lowers as insulation spaces 322 become larger.

On the other hand, where the reflection plate 320 is given an ordinary cylindrical shape in view of the light concentration efficiency, it is difficult to attain high positioning accuracy in attaching it. However, the accuracy of the position of the reflection plate 320 can be increased by giving positioning pins 306 to the reflection plate 320 and forming positioning holes 327 through the printed circuit board 324.

Sufficient insulation distances from the LED elements 325 can be secured by placing the positioning pins 306 at positions that are distant from the cylindrical LED elements 325.

The accuracy of the position of the reflection plate 320 can be made sufficiently high by placing the positioning pins 306 at three positions, and portions that are adjacent to the printed circuit board 324 and not close to the positioning pins 306 constitute insulation spaces 322. With this structure, cooling wind passage for cooling the LED elements 325 which heat up to a high temperature can be provided.

Referring to FIGS. 10(*a*)-10(*c*), the spatial structure of the portion including the positioning pins 306 of the refection plate 320 and the portion adjacent to the printed circuit board 324 will be compared with conventional structures.

In the structure shown in FIG. 10(*a*), long insulation distances are set between the LED elements 325 and the refection plate 320 to avoid contact between them. Illumination light 323 emitted from the LED elements 325 go straight and hence the light concentration efficiency of the refection plate 320 is low.

In the structure shown in FIG. 10(*b*), since the distances between the LED elements 325 and the refection plate 320 are not uniform, contact may occur to cause electrical trouble.

In the structure according to the embodiment shown in FIG. 10(*c*), the accuracy of positioning between the LED elements 325 and the refection plate 320 is high and the distances between them are uniform over the entire circumference. A minimum distance value can thus be attained. Therefore, the light concentration efficiency of the refection plate 320 is increased, whereby a highly efficient, semipermanently usable illumination device can be provided as the LED illumination device 305 (lower illumination device).

As described above, in the embodiment, the structure can be realized which not only maximizes the illumination efficiency of the LED illumination device 305 (lower illumination device) but also prevents electrical trouble. As a result, the life of the LED illumination device 305 is elongated and it comes to be semipermanently usable, which means that no replacement work is necessary for the LED illumination device 305. The ease of use is thus increased remarkably.

Furthermore, since the lower illumination device is the LED illumination device 305 which can operate on low-voltage power, necessary electric insulation performance can be attained by a simplified structure and hence safety can be increased by a simple structure.

Although the invention has been described in detail by referring to the particular embodiments, it is apparent to those skilled in the art that various changes and modifications are possible without departing from the spirit and scope of the invention.

The present application is based on Japanese Patent Application filed on Dec. 1, 2011 (Application No. 2011-263294), Japanese Patent Application filed on Dec. 1, 2011 (Application No. 2011-263295), and Japanese Patent Application filed on Dec. 28, 2011 (Application No. 2011-288444), the disclosures of which are incorporated herein by reference.

INDUSTRIAL APPLICABILITY

As described above, since the life of the lower illumination device is elongated and it comes to be semipermanently usable, the high-frequency heating device with a range hood according to the invention is effective when used as, for example, a device that has a circulation fan and is used in such a manner as to be installed over another cooking device. Furthermore, the high-frequency heating device with a range hood according to the invention is effective when used as a high-frequency heating device for not only a home use but also a business use.

The invention claimed is:

1. A high-frequency heating device with range hood which is installed over a heat-cooking device for cooking an object to be heated, comprising:

a heating chamber which is provided in a main body of the high-frequency heating device with range hood and which stores the object to be heated;

a high-frequency waves generation unit which supplies high-frequency power to an inside of the heating chamber;

a chamber illumination device disposed adjacent, from outside, to a wall of the heating chamber;

a lower illumination device which is disposed in a bottom portion of the main body of the high-frequency heating device with range hood and which illuminates the heat-cooking device; and a control unit which controls the high-frequency waves generation unit, the chamber illumination device, and the lower illumination device, wherein the lower illumination device is an LED illumination device using a light-emitting diode element mounted on a printed circuit board, and is supplied with power of a voltage lower than commercial power from a switching power supply which is controlled by the control unit, and wherein the lower illumination device comprises a plated reflection plate for light concentration of increased illumination efficiency mounted on the printed circuit board, the plated reflection plate including positioning pins configured to be received in positioning holes formed in the printed circuit board so as to provide insulation spacing at uniform distances between the light-emitting diode element and the plated reflection plate.

2. The high-frequency heating device with range hood according to claim 1, wherein the light-emitting diode element is mounted on an aluminum heat conduction plate having high heat conductivity to increase a heat dissipation effect, and wherein the aluminum heat conduction plate is mechanically fixed to the plated reflection plate and an attachment plate which releases heat from the aluminum heat conduction plate to a bottom wall of the heating chamber.

3. A high-frequency heating device with range hood which is installed over a heat-cooking device for cooking an object to be heated, comprising:

a heating chamber which is provided in a main body of the high-frequency heating device with range hood and which stores the object to be heated;

a high-frequency waves generation unit which supplies high-frequency power to an inside of the heating chamber;

a chamber illumination device disposed adjacent, from outside, to a side wall of the heating chamber;

a lower illumination device which is disposed in a bottom portion of the main body of the high-frequency heating device with range hood and which illuminates the heat-cooking device; and a control unit which controls the high-frequency waves generation unit, the chamber illumination device, and the lower illumination device, wherein the lower illumination device is an LED illumination device using a light-emitting diode, and is supplied with power from a switching power supply which is controlled by the control unit.

4. The high-frequency heating device with range hood according to claim 3, wherein the chamber illumination device is an LED illumination device using a light-emitting diode, and is supplied with power from the switching power supply which is controlled by the control unit.

5. A high-frequency heating device with range hood which is installed over a heat-cooking device for cooking an object to be heated, comprising:

a heating chamber which is provided in a main body of the high-frequency heating device with range hood and which stores the object to be heated;

a high-frequency waves generation unit which supplies high-frequency power to an inside of the heating chamber;

a chamber illumination device disposed adjacent, from outside, to a wall of the heating chamber;

a lower illumination device which is disposed in a bottom portion of the main body of the high-frequency heating device with range hood and which illuminates an object to be cooked in the heat-cooking device or a kitchen; and a control unit which controls the high-frequency waves generation unit, the chamber illumination device, and the lower illumination device, wherein the lower illumination device is an LED illumination device using a light-emitting diode element mounted on a printed circuit board, and is supplied with power from a switching power supply which is controlled by the control unit, and wherein the lower illumination device comprises a plated reflection plate for light concentration of increased illumination efficiency mounted on the printed circuit board, the plated reflection plate including positioning pins configured to be received in positioning holes formed in the printed circuit board so as to provide insulation spacing at uniform distances between the light-emitting diode element and the plated reflection plate.

6. The high-frequency heating device with range hood according to claim 5, wherein the reflection plate is formed by a resin mold comprising a plated surface to enhance the illumination efficiency and is configured to concentrate light emitted from the light-emitting diode element mounted on the printed circuit board to increase illuminance.

* * * * *